US006220183B1

(12) United States Patent
Schwitzky

(10) Patent No.: US 6,220,183 B1
(45) Date of Patent: Apr. 24, 2001

(54) STACKABLE PALLET

(75) Inventor: Volkmar Rolf Schwitzky, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/319,950

(22) PCT Filed: Dec. 19, 1997

(86) PCT No.: PCT/DE97/02981

§ 371 Date: Sep. 29, 1999

§ 102(e) Date: Sep. 29, 1999

(87) PCT Pub. No.: WO98/28197

PCT Pub. Date: Jul. 2, 1998

(30) Foreign Application Priority Data

Dec. 21, 1996 (DE) ..... 196 53 928

(51) Int. Cl.[7] ..... B65D 19/38

(52) U.S. Cl. ..... 108/53.3; 108/53.5; 108/56.3

(58) Field of Search ..... 108/53.1, 53.3, 108/53.5, 56.3, 57.25, 57.28, 901, 51.11

(56) References Cited

U.S. PATENT DOCUMENTS

| | | | | |
|---|---|---|---|---|
| 2,973,931 | * | 3/1961 | Brown | 108/53.3 |
| 3,233,564 | * | 2/1966 | Sullivan | 108/53.1 |
| 3,605,651 | * | 9/1971 | Stewart | 108/53.3 X |
| 3,641,949 | * | 2/1972 | Monk | 108/53.3 |
| 3,804,032 | * | 4/1974 | Baucom | 108/56.3 |
| 3,868,915 | * | 3/1975 | Hafner | 108/53.1 X |
| 5,527,585 | * | 6/1996 | Needham et al. | 108/53.1 X |
| 5,606,921 | * | 3/1997 | Elder et al. | 108/53.3 |
| 5,664,934 | | 9/1997 | Schaede et al. . | |
| 5,667,065 | * | 9/1997 | Fahrion | 108/53.1 X |

FOREIGN PATENT DOCUMENTS

| | | | |
|---|---|---|---|
| 4228204 | * | 3/1994 | (DE) . |
| 9217413 | | 5/1994 | (DE) . |
| 436783 | * | 7/1991 | (EP) . |
| 0725027 A2 | | 11/1995 | (EP) . |

* cited by examiner

*Primary Examiner*—Peter M. Cuomo
*Assistant Examiner*—Hanh V. Tran
(74) *Attorney, Agent, or Firm*—Jones, Tullar & Cooper PC

(57) ABSTRACT

A stackable pallet includes a support plate and a plurality of legs. The legs are structured so as to be inserted into each other to form a storage stack of pallets. The legs can be placed on top of each other to form a self-standing work stack of pallets.

7 Claims, 5 Drawing Sheets

STACKABLE PALLET

FIELD OF THE INVENTION

The present invention relates to a stackable pallet for forming a work or storage stack.

DESCRIPTION OF THE PRIOR ART

EP 0 725 027 A2 describes a pallet for depositing sheets on a stack. The pallets used in this connection are provided with support elements. These support elements are designed in such a way that selectively a storage stack of pallets or stack boards, which are stacked on top of each other with a first, small spacing between them, or a work stack of pallets or stack boards, which are stacked on top of each other with a second, larger spacing between, is formed.

DE 92 17 413 U1 describes a stackable packaging unit, wherein the pallets can be selectively stacked on top of each other with or without a space between them.

U.S. Pat. No. 3,641,949 discloses pallets which can be stacked on top of each other with a first spacing between them. By pivoting or rotating, the pallets, it is possible to stack them on top of each other at a second spacing from each other, wherein this second space is used for inserting the fork of a fork lift, but not for receiving material to be stacked.

SUMMARY OF THE INVENTION

The object of the present invention is based on providing a stackable pallet.

This object is attained in accordance with the present invention by the provision of a stackable pallet that has both a support plate and feet. The feet are arranged so that the pallets can be stacked on top of each other as a storage stack, and also as a work stack. The feet of each pallet telescope inside the feet of adjacent pallets for forming the storage stack. In the work stack arrangement, the feet on an upper pallet, which are provided with a base of their upper end and a resting place at their upper end, are received in the resting place of the feet of the pallet below.

The advantages which can be achieved by means of the present invention lie, in particular, in that it is possible to selectively form a work or a storage stack from the same group of pallets. In this case, the feet of the pallets, which are stacked on top of each other, both in the arrangement of the pallet in the work stack as well as the storage stack, are placed flush above each other in the vertical direction. Thus, occurring weights are transmitted in the vertical direction from the feet of the pallets on the top directly to the feet of pallets located under them. In this way, the transfer of the weight from a pallet to the pallet located underneath it takes place without the appearance of bending forces, by means of which bending of the pallets is reduced. A support plate of the pallet only needs to absorb the weight of the material stored on the support plate. Because of this optimized path of the forces, it is possible to make the pallets of the appropriate size, which considerably reduces the production costs and material costs.

DESCRIPTION OF THE DRAWINGS

The present pallet in accordance with the invention is represented in the drawings and will be described in greater detail in what follows.

Shown are in.

DESCRIPTION OF THE PREFERRED EMBODIMENTS

Figure 1:
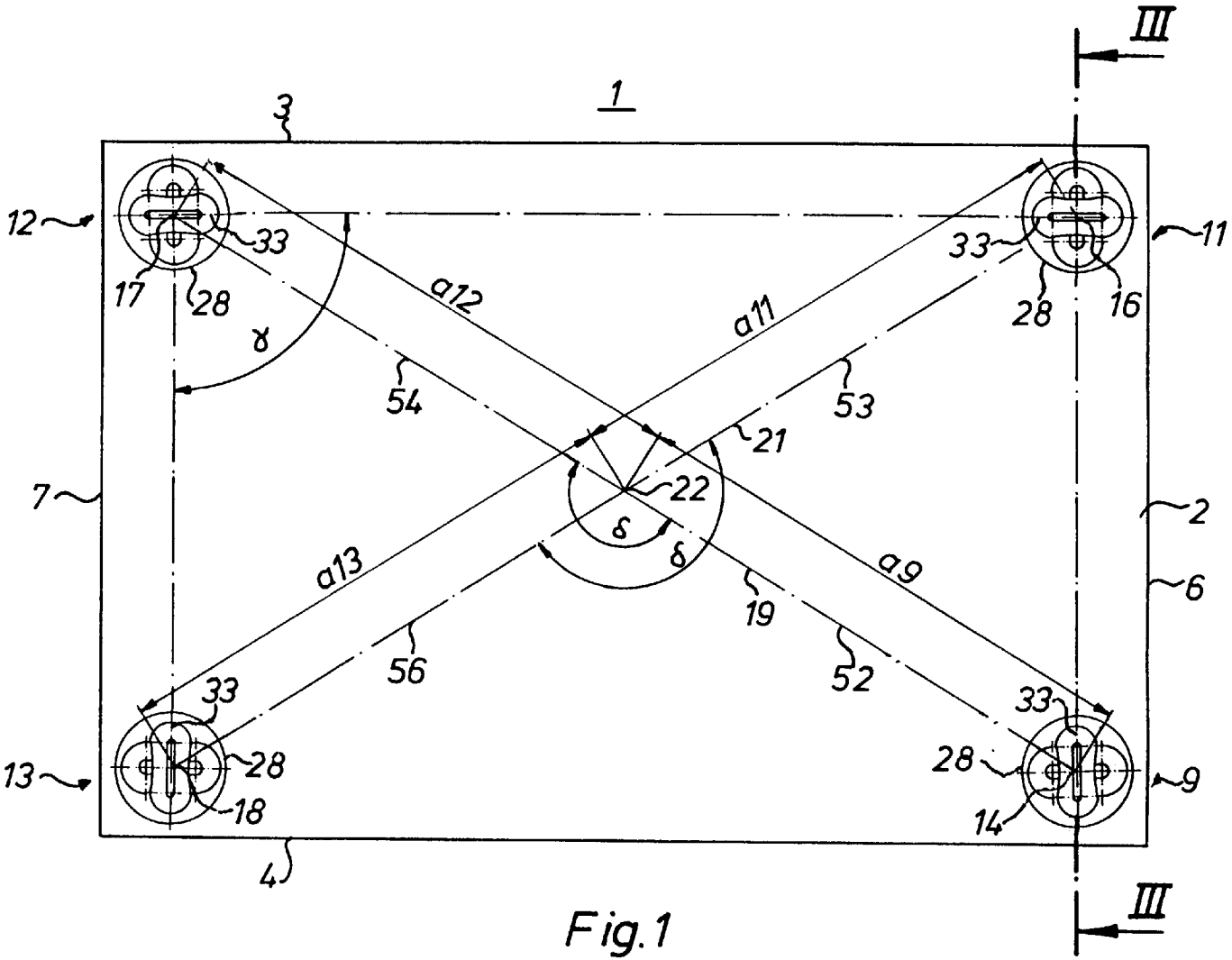
FIG. 1, a schematic view from above on a pallet in a first preferred embodiment, FIG. 2, a schematic lateral view of the pallet in FIG. 1, FIG. 3, a schematic sectional view through a work stack with three pallets stacked on top of each other, FIG. 4, a schematic sectional view through a storage stack with three pallets stacked on top of each other, FIG. 5, a schematic enlarged view from above on a foot of a pallet, and in FIG. 6, a schematic view from above on a pallet in a second preferred embodiment.

A stackable pallet as seen generally at 1 in FIG. 1, is preferably used as a stack board for depositing sheets for forming a stack. For example, this pallet 1 can be placed into a delivery device of a sheet processing machine. A plurality of these pallets 1 or stack boards are used in a raising and lowering device of the delivery device in connection with sheet-printing machines for printing securities in particular.

Figure 2:
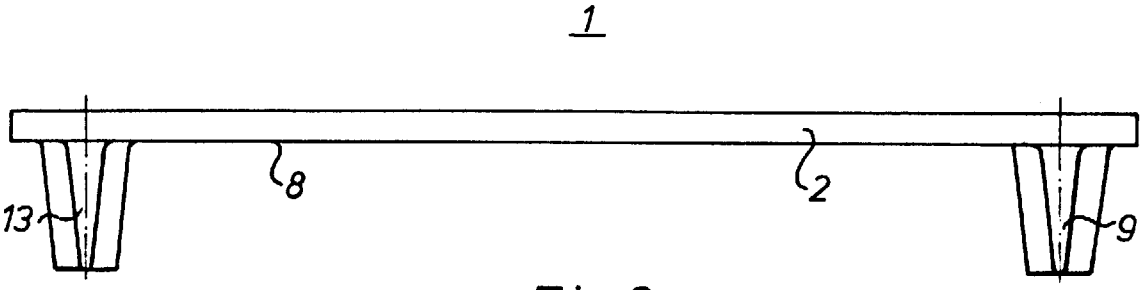

Such a pallet 1 has a support plate 2, which is designed to be essentially rectangular. Thus, in the present preferred embodiment, this support plate 2 has four lateral faces. Two longitudinal lateral faces or side edges 3, 4 lie parallel with each other and are perpendicular in relation to the two transverse lateral faces or sides edges 6, 7. Feet 9, 11, 12, 13 are fastened in or on the support plate 2 in the area of its corners, and these feet project out of an underside 8 of the support plate 8, as seen in FIG. 2. A first straight sectional line 19, and a second straight sectional line 21 are determined by centers 14, 17, or respectively 16, 18 of feet 9, 12, or respectively 11, 13, of a respective pair, which are located diagonally opposite each other. An intersection of these two straight sectional lines 19, 21 determines the origin of a pivot axis 22, which normally lies on a plane formed by the support plate 2, all as shown in FIG. 1. This pivot axis 22 and the centers 14, 17, or respectively 16, 18, of the feet 9, 12, or respectively 11, 13, of a respective pair each determine a straight line 52, 53, 54, 56, wherein a respective distance a9, a11, a12, a13 between the pivot axis 22 and the centers 14, 16, 17, 18 is of the same length, again as seen in FIG. 1. The straight lines 52, 54, or respectively 53, 56, of a pair enclose an opening angle 5, for example 180°. In this way, by pivoting the pallet 1 around a pivot angle, for example 180°, the centers 14, 17, or respectively 16, 18, of the feet 9, 12, or respectively 11, 13, of a pair change their positions, i.e. in place of the first foot 9, or respectively 11, of a pair, now the associated second foot 12, or respectively 13, of the pair is in the position of the first foot 9, or respectively 11. The opening angle 5 of the straight lines 52, 54, or respectively 53, 56, of a pair and the pivot angle are of the same size.

Figure 5:
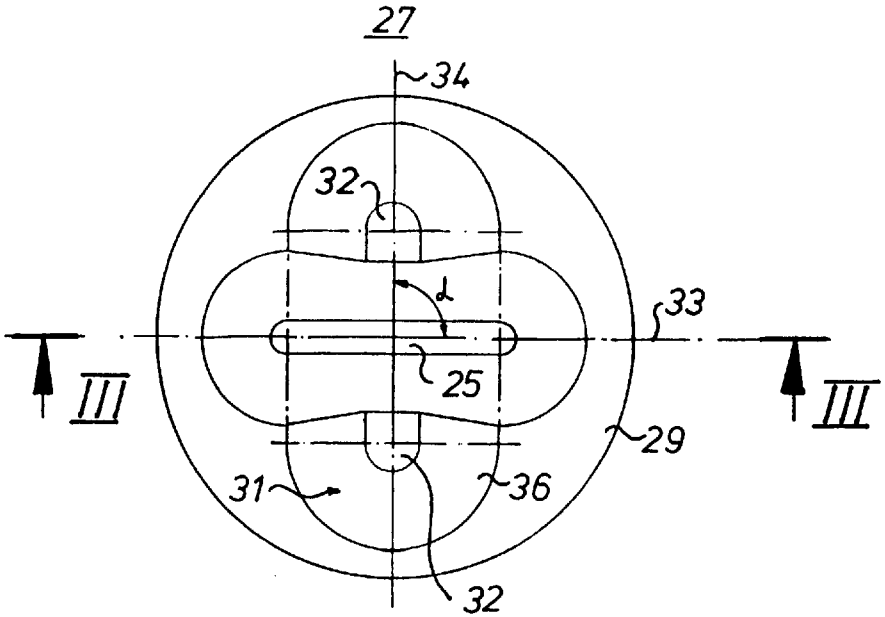
Figure 3:
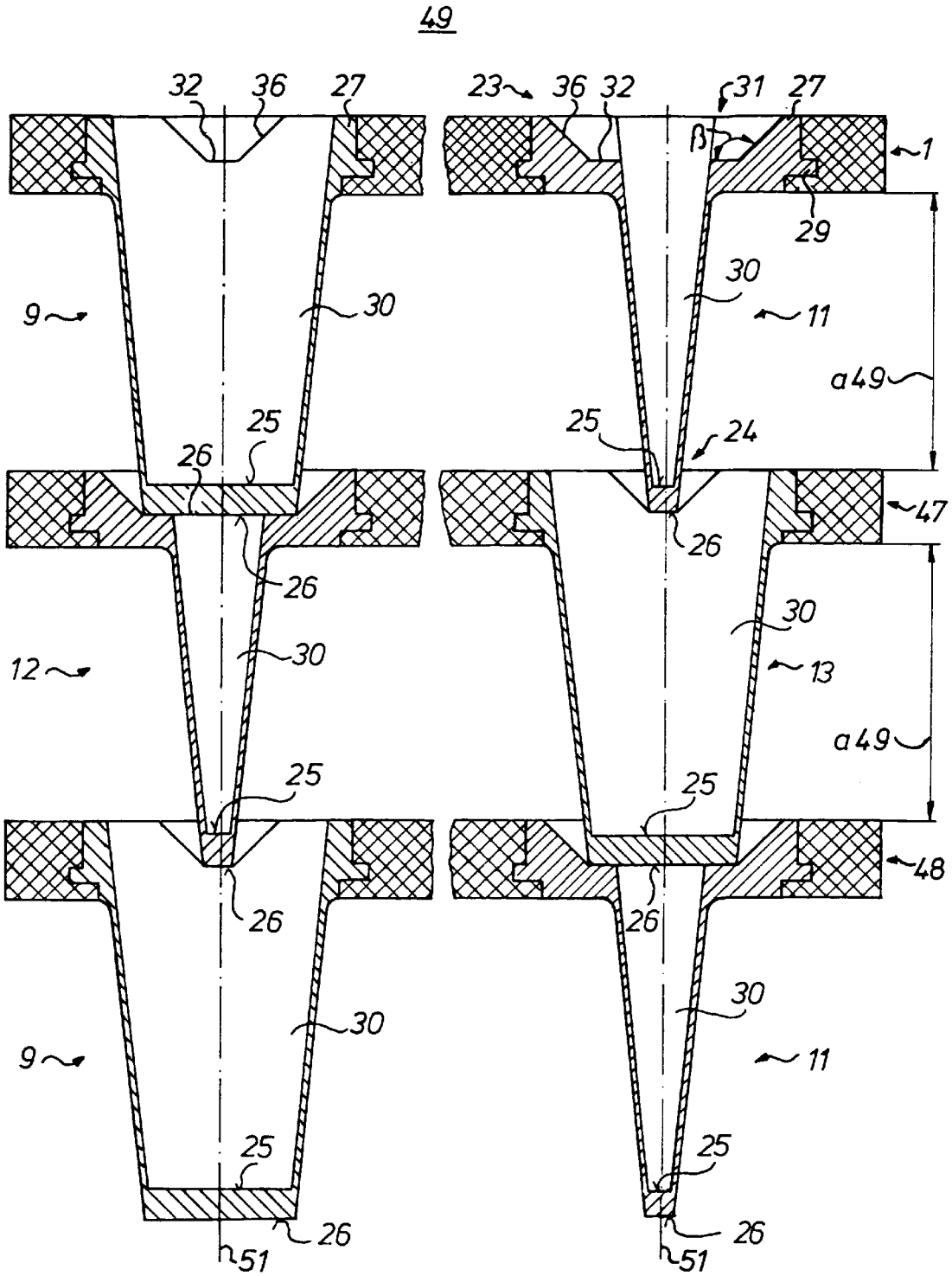
Figure 4:
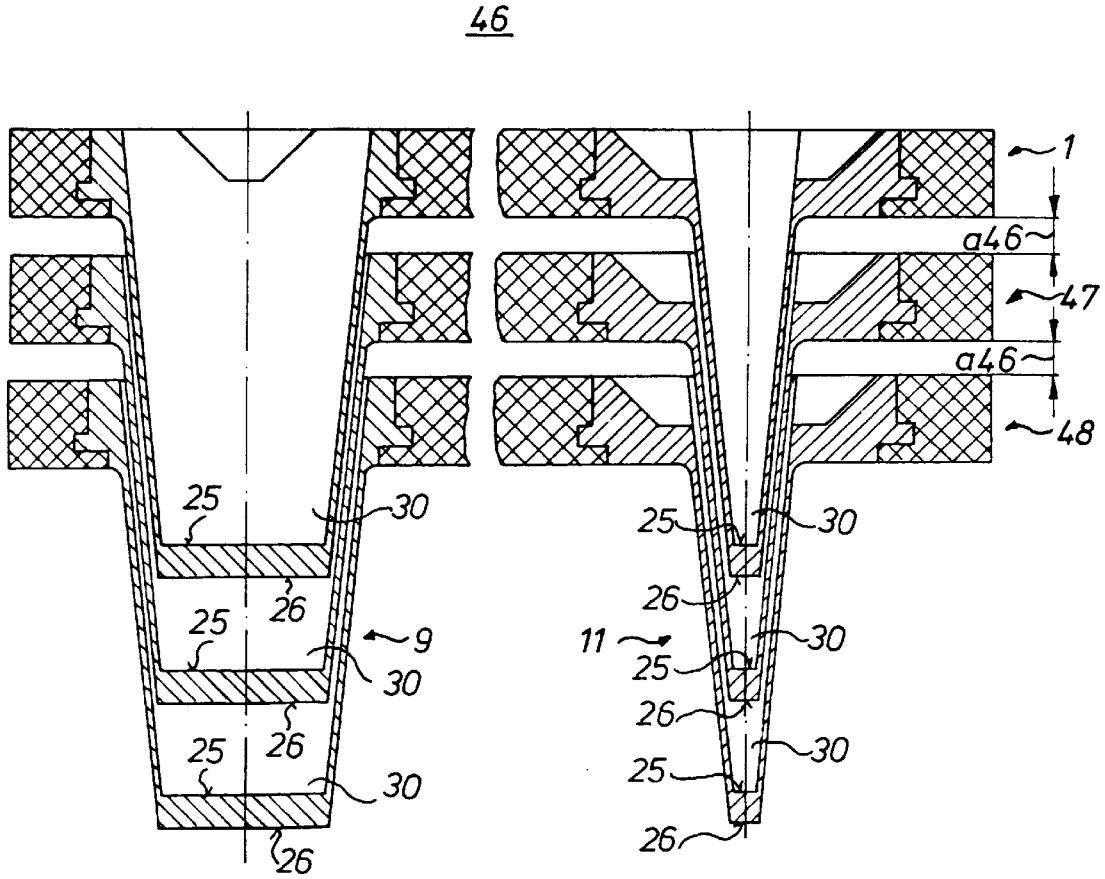

The feet 9, 11, 12, 13 are hollow, and in the present embodiments are designed in plan view in the shape of an elongated hole with rounded edges, as shown most clearly in FIG. 5. The feet 9, 11, 12, 13 are designed to be conical, i.e. to extend tapering, from their upper end 23 to their lower end 24, as seen in FIGS. 3 and 4. The bottom 25 of the lower end 24 of each foot 9, 11, 12, 13 is closed and is provided with a base 26. The upper end 23 is open and is provided with a circular flange 27 for supporting or fastening the feet 9, 11, 12, 13 in, or respectively on, the support plate 2. The support plate 2 for each foot 9, 11, 12, 13 is provided with a bore 28, in which the flange 27 is supported or fastened. This flange 27 has a collar 29, which is used to increase the load-bearing capacity and which is molded into the support plate 2 which, in the present example, is made of plastic. In the area of the foot upper end 23, the inside of the flange 27 is provided with a depression 31 which is embodied as a resting place. This depression 31 is used as a centering element for feet 9, 11, 12, 13 stacked on top of each other. A depression base surface 32, i.e. a resting place of this depression 31 is matched to the base 26 of the lower end 24 of the foot 9, 11, 12, 13. The base surface 32 is interrupted by the foot 9, 11, 12, 13 so that, strictly speaking, two partial depression base surfaces 32 are provided for each foot. For the sake of simplicity, however, the two partial surfaces and their virtual extension are understood to be the base surface 32 in what follows, so that this base surface 32 in the flange 27 corresponds in shape and size approximately to the base 26 at the lower end 24 of the foot 9, 11, 12, 13, all as seen in FIGS. 3, 4 and 5. A longitudinal axis 34 of this base surface 32 in the shape of an elongated hole, and a longitudinal axis 33 of the plan view in the shape of an elongated hole of the foot 9, 11, 12, 13 enclose an opening angle a of, for example, 90°. An inclined, circumferential lateral surface 36 which, for example, encloses an opening angle B of 135°, leads from a top of the flange 27 to this base surface 32.

A hollow interior 30 of the respective foot 9, 11, 12, 13 is matched to the associated exterior contour, so that the feet 9, 11, 12, 13 can be pushed into each other when the pallets are in there storage stack orientation, as shown in FIG. 4.

A pair of diagonally opposed feet 9, 12, or respectively 11, 13, lying on a straight sectional line 19, 21, are respectively arranged in such a way, that the centers 14, 17, or respectively 16, 18, of both feet 9, 12, or respectively 11, 13, have the same distance a9, a12, or respectively a11, a13, from the pivot axis 22, and the extensions of the longitudinal axes 33 of both feet 9, 12, or respectively 11, 13, enclose an angle r of 90° in respect to each other.

In the first preferred embodiment, respectively one longitudinal axis 33 of a foot 11, 12 extends parallel with a longitudinal lateral face 3, 4, and the longitudinal axis 33 of the corresponding foot 9, 13 of a pair of digonally opposed feet 9, 12, or respectively 11, 13, extends perpendicularly in respect to this, first longitudinal axis i.e. parallel with a transverse lateral face 6, 7.

Figure 6:
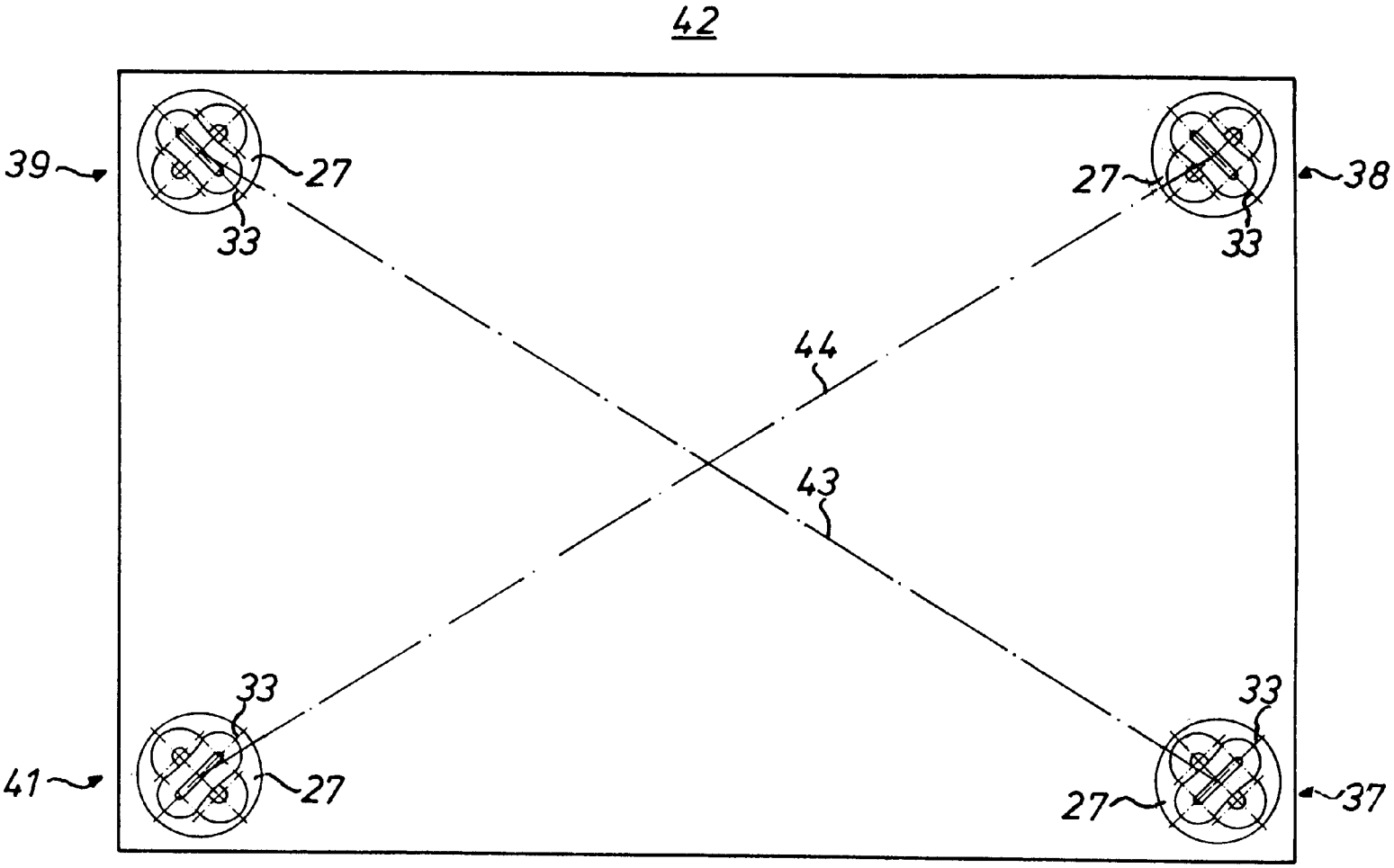

In a second preferred embodiment of a pallet 42, as seen in FIG. 6, feet 37, 38, 39, 41 are used, which are like the feet 9, 11, 12, 13 in the first preferred embodiment. Here, the longitudinal axes 33 of all of the feet 37, 38, 39, 41 are arranged at an angle of 45° in relation to the longitudinal and transverse lateral faces of the pallet 42. The longitudinal axis 33 of a first foot 37, or respectively 39, of a pair of diagonally opposed feet 37, 39, or respectively 38, 41, extends perpendicularly in respect to a line which halves the angle of the associated longitudinal and transverse lateral faces, i.e. approximately perpendicularly in respect to the associated straight sectional line 43, or respectively 44. The longitudinal axis 33 of a corresponding second foot 39, or respectively 41, of the pair extends parallel with a line which halves the angle of the associated longitudinal and transverse lateral faces, i.e. approximately parallel in respect to the associated straight sectional line 43, or respectively 44.

To form a storage stack 46, of pallets, as shown in FIG. 4 pallets 1, 47, 48 are aligned in the same way and are stacked on top of each other, i.e. the feet 9, 11, 12, 13 of an upper pallet 1 are pushed into or telescope into the corresponding hollow feet 9, 11, 12, 13 of the pallets 47, 48 located below. Spacers, not represented, have been attached to the pallets 1, 47, 48. This results in a first minimum distance a46 between the support plates 2 of the pallets 1, 47, 48. These pallets 1, 47, 48 can also rest directly on each other, so that there is no distance a46.

If it is now intended to form a self-supporting work stack 49, or pallets, as shown in FIG. 3 pallets 1, 47, 48, which are stacked on top of each others, are alternatingly turned by 180° around the pivot axis 22. With this arrangement, the longitudinal axes 33 of feet 9, 11, 12, 13 arranged on top of each other are alternatingly turned by 90° in respect to a vertical axis 51 formed through the centers 14, 16, 17, 18 of the feet 9, 11, 12, 13. This vertical axis 51 extending through the centers 14, 16, 17, 18 of the feet 9, 11, 12, 13 is the same, i.e. is fixed in place, in the work stack 49, as well as in the storage stack 46.

The feet 9, 11, 12, 13 of the pallets 1, 47, 48 transfer the weight of the pallets 1, or respectively, 47, directly in the vertical direction to the feet 9, 11, 12, 13 of pallets 47, or respectively 48 located below them.

To form a work stack 49 from a storage stack 46, the required pivot angle is a function of the arrangement of the feet 9, 11, 12, 13. For example, with an arrangement of the feet 9, 11, 12, 13 in the shape of a square, a pivot angle of only 90° is required for forming work stacks and storage stacks 49, 46 which are differently distanced.

If an uneven number of feet is provided, all feet must be at the same distance from the pivot axis. Straight connecting lines between the center of the feet and the pivot axis respectively enclose opening angles of the same size. Thus, the feet are arranged at the same graduation angle on a graduated circle around the pivot axis. In this case, a pivot angle equals the opening angle, or corresponds to a whole-number multiple of the opening angle.

The shape of the feet 9, 11, 12, 13 can also be selected to be quite different. However, all shapes must have in common that for forming a storage stack 46 the feet 9, 11, 12, 13 are movable into each other, preferably slidable, or telescoping and for forming a work stack 49. These feet 9, 11, 12, 13 rest on top of each other. In this case, the contact zones forming between the bases 26 and the base surfaces 32 of the feet resting on top of each other lie flush on top of each other along a vertical straight line.

Because of the pivoting of the pallet 1, 47, 48 for forming a work stack 49, the feet 9, 11, 12, 13 in the preferred embodiments rest on top of each other in a position which is pivoted around their longitudinal axis 51.

Because of this, the longitudinal axes 51 of the feet 9, 11, 12, 13 stacked on top of each other lie on a straight line, i.e. the feet 9, 11, 12, 13 lie directly on top of each other.

In place of pivoting the entire pallet 1, 47, 48, it is also possible to respectively pivot or rotate the individual feet, and to stack the support plates on top of each other without pivoting of the support plate.

The cross section of feet lying on top of each other in a storage stack are approximately congruent. To form a work stack, the feet are stacked on top of each other by means of a pivot movement, for example of the entire pallet, or of individual feet, in such a way that the cross sections of feet lying on top of each other are not congruent and therefore can be placed on top of each other.

While preferred embodiments of a stackable pallet in accordance with the present invention have been set fully and completely hereinabove, it will be apparent to one of skill in the art that a number of changes in, for example the overall size of the pallets, the specific material used to form the pallets and the like could be made without departing from the true spirit and scope of the present invention which is accordingly to be limited only by the following claims.

What is claimed is:

1. A stackable pallet comprising:

a support plate;

a plurality of feet arranged on said support plate, said plurality of feet on said support plate being adapted to be telescopingly received in feet of other pallets to form a storage stack of said pallets with said pallets in the storage stack spaced at a first distance, and said plurality of feet on said support plate being adapted to be placed on top of feet of other pallets to form a work stack of said pallets with said pallets spaced in the work stack spaced at a second distance, said second distance being greater than said first distance;

an interrupted resting place formed at an upper end of each said foot adjacent said support plate; and a base formed at a lower end of each said foot, each said pallet being orientable in a work stack forming position with said base of each said foot being received on said interrupted resting place of an adjacent one of said pallets when said pallets are formed in said work stack, each said pallet being orientable in a storable stack position with said feet of each of said pallets being telescopingly received in feet of an adjacent one of said pallets with said base of each said foot passing through said interrupted resting place of an adjacent one of said pallets, said interrupted resting place on each said foot centering said base of said foot received in it when adjacent ones of said pallets are oriented to form said work stack and said storage stack.

2. The stackable pallet of claim 1 wherein each of said plurality of feet on each said support plate is rotatable about a vertical axis of each of said feet, said vertical axis being generally perpendicular to a plane of said support plate.

3. The stackable pallet of claim 1 wherein said support plate has a central pivot axis and wherein said support plate is rotatable about said pivot axis through an opening angle between first and second positions, all said support plates being in said first position to form said storage stack of said pallets and alternating ones of said support plates being in said first and second positions respectively to form said work stack, and further wherein a first pair of said plurality of feet on each said support plate and a second pair of feet on each said support plate are arranged at first and second distances from said pivot axis, and futher wherein straight lines between each of said first pair of feet and said pivot axis intersect at said opening angle.

4. The stackable pallet of claim 1 wherein said support plate has a pivot axis and further wherein each of said plurality of feet is at an equal distance on said support plate from said pivot axis.

5. The stackable pallet of claim 1 wherein said plurality of feet are arranged as pairs of feet and further wherein said feet in each said pairs of feet have the same cross sectional shape.

6. The stackable pallet of claim 1 wherein each of said plurality of feet has a cross-sectional shape and a longitudinal axis and further wherein longitudinal axes of a pair of said plurality of feet are arranged at an opening angle with respect to each other.

7. The stackable pallet of claim 6 wherein said opening angle is approximately 90°.

* * * * *